United States Patent [19]

Venkatesan

[11] Patent Number: 4,722,395

[45] Date of Patent: Feb. 2, 1988

[54] VISCOUS OIL RECOVERY METHOD

[75] Inventor: V. N. Venkatesan, Arlington, Tex.

[73] Assignee: Mobil Oil Corporation, New York, N.Y.

[21] Appl. No.: 946,258

[22] Filed: Dec. 24, 1986

[51] Int. Cl.[4] ..... E21B 43/243

[52] U.S. Cl. ..... 166/261; 166/272

[58] Field of Search ..... 166/261, 272

[56] References Cited

U.S. PATENT DOCUMENTS

| | | | |
|---|---|---|---|
| 3,375,870 | 4/1968 | Satter et al. | 166/261 X |
| 3,515,212 | 6/1970 | Allen et al. | 166/261 X |
| 3,938,590 | 2/1976 | Redford et al. | 166/270 |
| 3,964,546 | 6/1976 | Allen | 166/261 |
| 3,976,137 | 8/1976 | Bousaid | 166/272 |
| 3,978,925 | 9/1976 | Redford | 166/261 |
| 3,993,132 | 11/1976 | Cram et al. | 166/261 |
| 4,046,195 | 9/1977 | Cram et al. | 166/272 |
| 4,098,336 | 7/1978 | Allen | 166/261 |
| 4,114,690 | 9/1978 | Cram et al. | 166/261 |
| 4,127,172 | 11/1978 | Redford et al. | 166/261 |
| 4,133,382 | 1/1979 | Cram et al. | 166/261 X |
| 4,427,066 | 1/1984 | Cook | 166/261 |
| 4,450,911 | 5/1984 | Shu et al. | 166/263 |
| 4,456,066 | 6/1984 | Shu | 166/272 |
| 4,498,537 | 2/1985 | Cook | 166/261 X |
| 4,565,249 | 1/1986 | Pebdani et al. | 166/303 |
| 4,593,759 | 6/1986 | Penick | 166/261 |

FOREIGN PATENT DOCUMENTS

| | | | |
|---|---|---|---|
| 840211 | 4/1970 | Canada | 166/261 |

OTHER PUBLICATIONS

Walter, "Application of Heat for Recovery of Oil: Field Test Results and Possibility of Profitable Operation", *Journal of Petroleum Technology*, Feb. 1957, pp. 16–22.

Cram et al, "Low Temperature Oxidation Process for Recovery of Bitumen", *The Journal of Canadian Petroleum Technology*, Jul.–Sep. 1977, Montreal, pp. 72–83.

Meldau et al, "Cyclic Gas/Steam Stimulation of Heavy-Oil Wells", *Journal of Petroleum Technology*, Oct. 1981, 1940–1988.

*Primary Examiner*—George A. Suchfield

*Attorney, Agent, or Firm*—Alexander J. McKillop; Michael G. Gilman; Lawrence O. Miller

[57] ABSTRACT

A viscous oil-bearing formation is produced by a steam flood technique in which the quality of the steam injected into the formation through an injection well is improved in-situ by the generation of an in-situ heat zone which trails along behind the front of the steam flood. This in-situ heat zone is generated by the injection of a non-condensable oxidant which reacts with the residual oil left behind the steam front in the steam swept zone. The oxidant injection is controlled so that the velocity of the heat zone through the formation is no greater than the velocity of the steam front, thereby preventing heat zone breakthrough of the steam front.

11 Claims, 3 Drawing Figures

VISCOUS OIL RECOVERY METHOD

BACKGROUND OF THE INVENTION

In the recovery of oil from oil-containing formations, it usually is possible to recover only minor portions of the original oil in place by the so-called primary recovery methods which utilize only the natural forces present in the formation. Thus, a variety of supplemental recovery techniques have been employed in order to increase the recovery of oil from subterranean formations. Since it is known that the viscosity of oil decreases markedly with an increase in temperature, thermal recovery methods such as in-situ combustion and steam flooding have been employed.

In the in-situ combustion process an oxygen containing gas is introduced into the formation and high temperature combustion of the reservoir oil is initiated and maintained. The oxygen reacts with the residual oil laid down during the process to generate heat and, as a result, carbon oxides are formed. In this process the heat of combustion is given up to the reservoir oil, thereby lowering the viscosity of the oil over a substantial portion of the formation and enhancing the recovery of the oil. Because of high temperature, the reaction rate is high. Another recovery technique is the low temperature oxidation process which is similar to the high temperature oxygen combustion process except that a lower temperature (between 250°-600° F.) is maintained so that oxygen is chemically uptaken by the oil with little, if any, formation of carbon oxides like $CO_2$, CO, etc. With reaction rate slower than for combustion, less oxygen is consumed. For a given amount of oxygen injected, greater area of the reservoir being heated when compared to the high temperature oxygen combustion process. However, an adverse effect of low temperature oxidation is the increase in oil viscosity, which decreases oil mobility.

These thermal recovery methods have not been successful all the time. In the high temperature oxygen combustion and low temperature oxidation processes much heat is left behind in the swept formation and most of this goes to waste. On the other hand, the steam flood process is often limited by heat losses in the injected steam at the surface, in the wellbore, and in the formation. As a result, the high quality steam process originally intended is often down graded to a low quality steam process, or even to a hot waterflood. This heat loss is large when the steam is applied in a thermal recovery process in a deep reservoir.

There is therefore a present need for compensating for such heat losses in the thermal oil recovery processes. The present invention is particularly directed to compensating for the heat losses in the steam flood process by the in-situ generation of heat for the purpose of maintaining the high steam quality desired for enhancing oil recovery during such a steam flood process.

SUMMARY OF THE INVENTION

In accordance with the present invention there is provided a steam flooding method for recovering oil from a subterranean viscous oil-bearing formation in which the quality of the injected steam is improved through in-situ heat generation, thereby enhancing oil recovery during such steam flooding.

More particularly, steam is injected into the viscous oil-bearing formation to establish thermal communication through said formation from an injection well to at least one production well. This thermal communication is accelerated by establishing an in-situ combustion (quenched) zone behind the steam front (or steam swept zones) of the steam flood for upgrading the quality of the injected steam which in turn increases the velocity of the steam front through the formation. In addition, carbon dioxide is generated within the in-situ combustion zone and travels with the steam front for increasing the mobility of the oil being swept by the steam front toward the production well. The combustion zone breakthrough ahead of the steam front is prevented by maintaining the velocity of the combustion zone at a velocity no greater than that of the steam front.

To generate the in-situ heat by the combustion zone trailing behind the steam front, a non-condensable oxidant is either coinjected or alternately injected into the formation along with the steam. This oxidant reacts with the residual oil left in the steam swept zone behind the advancing steam. It is this combustion reaction that produces both the in-situ heat for increasing steam quality and the carbon dioxide for improving oil mobility. The ratio of the oxidant-to-steam is controlled so as to increase steam quality several fold while at the same time insuring that breakthrough of the steam front by the heat zone does not occur.

DESCRIPTION OF THE PREFERRED EMBODIMENT

The present invention is directed to a method of steam flooding an oil-containing formation in which in-situ heat is generated behind the steam front by the coinjection of a non-condensable oxidant. This addition of oxidant improves the displacement efficiency of the steam by the additional in-situ heat created through the oxidation reaction of oxygen and the residual oil left behind the steam front in the steam sweep zone. Thus, oil recovery in a reservoir containing viscous heavy oil is enhanced.

Figure 1:
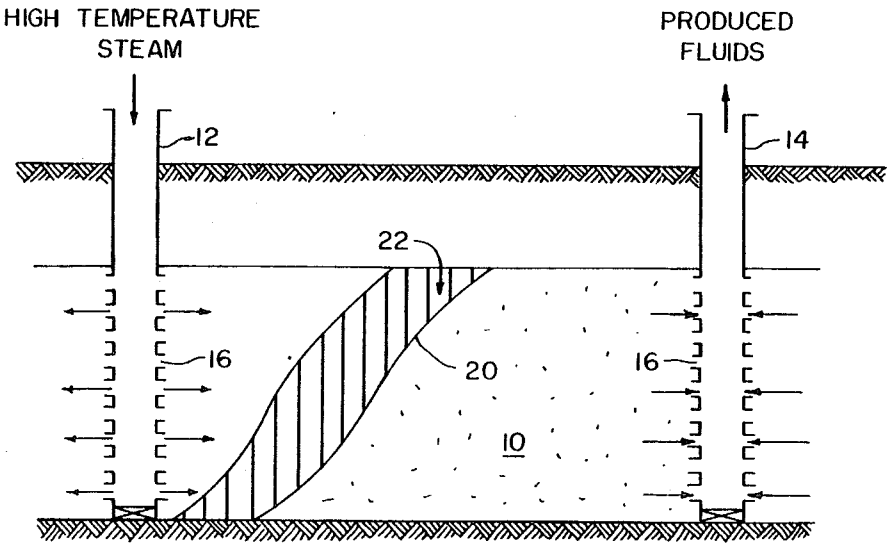
FIG. 1 shows a subterranean viscous oil-containing formation penetrated by an injection well and a spaced-apart production well illustrating the oxygen/steam coinjection method of the present invention.

Referring to FIG. 1, a viscous oil-bearing formation 10 is penetrated by an injection well 12 and a spaced-apart production well 14. Both wells 12 and 14 are in fluid communication with the oil-bearing formation 10 through pre-selected perforations 16. Initially, high temperature steam, up to 600° F., for example, is injected into well 12 and fluid communication between wells 12 and 14 is established by the resulting steam flood. Fluid production, including oil, through production well 14 continues until the fluids being recovered contain an unfavorable amount of steam or water, preferably at least 90% water. When the formation 10 contains a viscous heavy oil or bitumen such a steam drive operation is adversely affected by reversal in oil viscosity from low to high as the oil being heated by the steam flood advances toward the production well and enters a cold region of the formation. To overcome this problem, the present invention is directed to a method of accelerating the establishment of thermal communication between the injection and production wells. This is accomplished by establishing a steam front 20 that moves through the formation 10 ahead of a trailing heat zone 22. By keeping the heat zone immediately behind the steam front, additional in-situ heat is continually being applied to the steam front to maintain or increase steam quality as the steam front moves through the formation, thereby accelerating thermal communication between wells 12 and 14. Steam and a non-condensable oxidant, such as pure oxygen, for example, are injected through injection well 12 preferably in the form of a mixture in order to generate the heat zone 22. The composition of oxygen in the steam-oxygen mixture may, for example, be low, in the order of 3% oxygen to 97% steam. The oxygen reacts with the residual oil left behind in the steam swept zone in accordance with the following expression:

$$\text{Oil} + O_2 \rightarrow CO_2 + CO + \text{Heat.} \quad (1)$$

For each cubic foot of oxygen reacted, 500 BTU of heat is produced. In addition to the heat provided by the burning of this residual oil, carbon dioxide is also generated which travels with the steam front to make the oil being displaced by the steam front even more mobile.

This conijection of steam and oxygen is continued until steam breaks through at the production well indicating the establishment of thermal communication between the injection and production wells. Thereafter, the injection of steam alone is continued until the water and oil ratio in the produced fluids is again unacceptable. In an alternate embodiment, the steam may initially be injected into the formation followed by a separate injection of oxygen. These separate injections may be alternately repeated until fluid production is again unacceptable.

Figure 2:
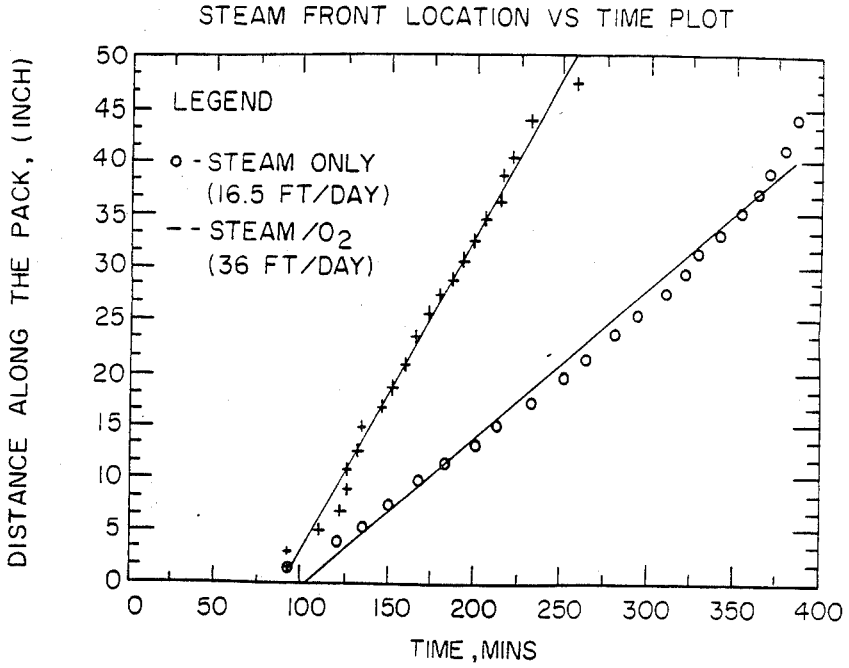
FIG. 2 shows a plot of the steam front location of FIG. 1 with time for a steam only injection and for an oxygen/steam coinjection.

The method of the present invention may be more fully understood by the following description taken in conjunction with FIG. 2. An element of a reservoir was simulated using a linear pack system. A viscous oil having a viscosity of 800 cp was used in a 50 inch pack. Steam at 500 psig was injected until the steam front, as indicated by 450° F. leading edge, had moved 3 inches from the injection end of the pack. Subsequently, a gas containing 95% oxygen and 5% nitrogen was coinjected with steam. The composition of the oxidant in the steam-oxidant mixture was 3 Mol. %. Two runs were made, one with steam along and one with the steam-oxidant mixture. FIG. 2 shows the advancement rate of the steam front. The addition of oxygen increased the steam velocity nearly two-fold and there was no evidence of a high temperature front. However large $CO_2$ in the product gas indicates the presence of quenched combustion. From these results it is clear that steam velocity is accelerated by the coinjection of oxygen to establish faster thermal communication between injection and production wells.

Figure 3:
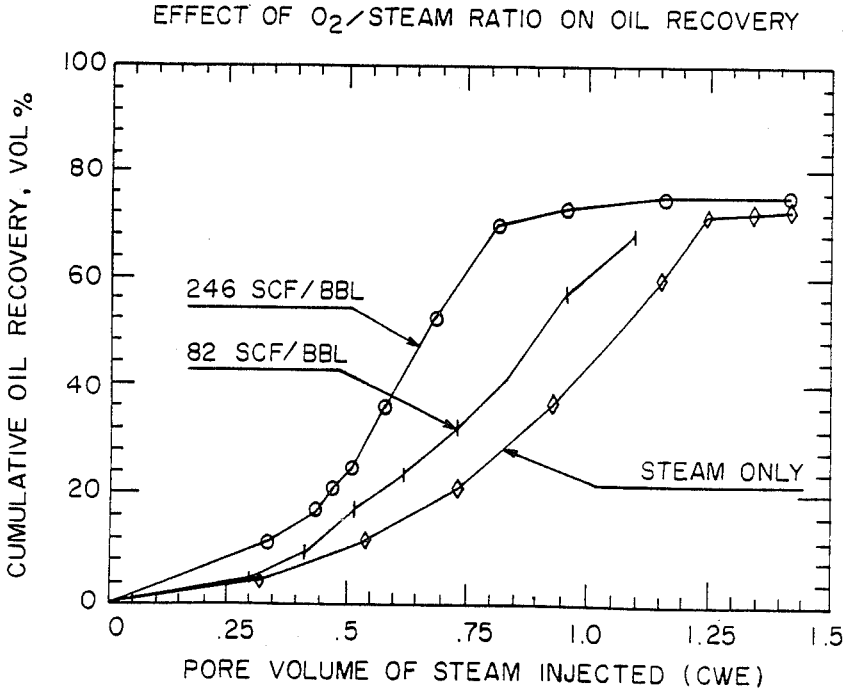
FIG. 3 shows the effects of an oxygen/steam coinjection on oil recovery in an oil-containing formation such as shown in FIG. 1.

It is important that the volumes of oxygen and steam injected be controlled to maintain the heat zone behind the steam front. In one example, shown in FIG. 3, an oxygen-steam ratio of 245 scf/bbl (i.e. 3% oxygen) increased a 20% steam quality to about 80%, thus greatly improving oil recovery over a 20% quality steam only injection. This coinjection of oxygen and steam provides even better oil recovery than for 80% steam injection alone. For any reservoir with a specified volume and quality of steam injected there exists a maximum value for the oxygen-to-steam ratio that can be injected without oxygen breakthrough ahead of the steam front.

As a further example, the oxygen-to-steam ratio was determined for the Cantuar field as follows. A reservoir model of the field was used to predict this ratio. This model reflected the formation depositional environment of the Cantuar field as cyclic sedimentation associated with a non-marine fluvial environment. Sands deposited were point bar and channel sands. The Cantuar sand is also a medium grained, quartz sandstone, well sorted and cemented with kaolinite. The model was used to predict the oil recovery in a 40 acre, inverted nine-spot pattern. Average reservoir depth was 3200 feet, initial reservoir pressure was 900 psi, and oil saturation uniform at 40%. The model contained three wells. One well was a steam injection well and the other two were production wells. The production well closest to the injection well represented the production well in the field. The other production well was an aquifer well that allowed fluid to move out of the pattern area if needed. The distance between the injection well and the closest production well was 800 feet, which represents the average distance in a 40 acre, inverted nine-spot pattern.

In this model, a total of five cases were studied:

(1) 20% quality steam only
(2) 80% quality steam only
(3) 20% quality steam only+270 scf/bbl $O_2$
(4) 20% quality steam only+130 scf/bbl $O_2$
(5) 20% quality steam only+560 scf/bbl $O_2$ The steam injection rate was based on an average of 1.5 bbl/day per acre foot of reservoir.

It was found that the addition of 130 scf/bbl $O_2$ to the steam for case 4 was somewhat better than the 20% quality steam only for case 1 as far as recovery was concerned (29.0% for case 4 as compared to 23.1% for case (1). It was further found that the 80% quality steam only of case 2 and the 270 scf/bbl $O_2$ addition to the 20% quality steam of case 3 were almost equivalent in their recoveries (56.0% for case 2 and 58.5% for case 3). Case 5 for the 560 scf/bbl $O_2$ addition to the 20% qualities steam yielded a recovery of 64.0%, however, it was noted that the process had now switched from being supported mainly by steam to one driven by combustion. Further investigation showed that 500 scf/bbl is the breakpoint where more energy is being produced by the oxygen combustion than by the steam. Accordingly, the oxygen to steam ratio should not exceed about 500 scf/bbl since the purpose of the coinjection of oxygen is to provide additional heat to the steam front without breakthrough of the steam front.

Having now described the method of the present invention, it will be apparent to those skilled in the art that various changes and modifications may be made in such method without departing from the spirit and scope of the invention as set forth in the appended claims. Any such changes and modifications coming within the scope of such appended claims are intended to be included herein.

I claim:

1. A method for recovering oil from a subterranean viscous oil-bearing formation penetrated by at least one injection well and at least one spaced-apart production well, said wells being in fluid communication through a portion of the formation, comprising the steps of:

(a) injecting steam having a quality of 20% into the viscous oil-bearing formation through the injection well to create a steam front that moves through the formation toward the production well, (b) injecting a non-condensable oxidant into the viscous oil-bearing formation through the injection well to create a heat zone behind the steam front by the oxidation reaction of said oxidant with the residual oil left in the steam swept zone behind the steam front as it moves through said formation, and controlling the volume of oxidant to maintain the heat zone behind the steam front without oxidant breakthrough ahead of the steam front thereby increasing the steam quality of the steam front to at least 80% and accelerating the velocity of the steam front through the formation, (c) continuing to inject said oxidant until thermal communication is established between the injection well and the production well, and (d) recovering fluids, including oil, from the formation through the production well.

2. The method of claim 1 wherein during step (b) said oxidant is coinjected with steam having a quality of 20% into the formation in the form of a mixture of steam and oxidant.

3. The method of claim 2 wherein said mixture comprises no more than 3% oxidant.

4. The method of claim 1 wherein said oxidant is at least 95% oxygen.

5. The method of claim 4 wherein said oxidant is pure oxygen.

6. The method of claim 1 wherein steps (a) and (b) are alternately repeated.

7. The method of claim 2 wherein said ratio of oxidant-to-steam is no greater than 500 scf oxidant per barrel of steam.

8. The method of claim 2 wherein the steam and the amount of oxidant coinjected with steam into the formation during step (b) is sufficient to raise the quality of the steam along the in-situ steam front to at least 80%.

9. The method of claim 8 wherein the amount of injected oxidant does not exceed 500 scf of oxidant per barrel of injected 20% quality steam.

10. The method of claim 9 wherein the amount of injected oxidant is in the order of 270 scf of oxidant per barrel of 20% quality steam.

11. The method of claim 1 further including the step of injecting steam into the formation through the injection well and recovering fluids including oil from the formation via the production well after step (d) until the fluids recovered contain an unfavorable oil to water ratio.

* * * * *